US007266342B2

(12) United States Patent
Alkhateeb et al.

(10) Patent No.: US 7,266,342 B2
(45) Date of Patent: Sep. 4, 2007

(54) SATELLITE TO VEHICLE DATA COMMUNICATION METHOD

(75) Inventors: Abedulah Alkhateeb, Troy, MI (US); Benedetto P DiCicco, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 578 days.

(21) Appl. No.: 10/659,886

(22) Filed: Sep. 11, 2003

(65) Prior Publication Data

US 2005/0059340 A1 Mar. 17, 2005

(51) Int. Cl.
*H04H 1/00* (2006.01)

(52) U.S. Cl. ..... 455/3.02; 455/566; 455/456.2

(58) Field of Classification Search ..... 455/3.02, 455/3.04, 566, 557, 456.1, 3.01, 12.1, 3.06; 704/500; 725/134; 456/456.2
See application file for complete search history.

(56) References Cited

U.S. PATENT DOCUMENTS 6,553,077 B2 4/2003 Rindsberg et al.
6,785,551 B1 * 8/2004 Richard ..... 455/456.1
2002/0132575 A1 * 9/2002 Kesling et al. ..... 455/2.01
2002/0184037 A1 * 12/2002 Patsiokas et al. ..... 704/500
2004/0040036 A1 * 2/2004 An ..... 725/39
2004/0058641 A1 * 3/2004 Acker ..... 455/3.02
2004/0192189 A1 * 9/2004 Yuhara et al. ..... 455/3.02
2004/0266336 A1 * 12/2004 Patsiokas et al. ..... 455/3.04
2005/0005307 A1 * 1/2005 Kim ..... 725/131

* cited by examiner

*Primary Examiner*—Matthew Anderson
*Assistant Examiner*—Tan Trinh
(74) *Attorney, Agent, or Firm*—Ralph E. Smith

(57) ABSTRACT

A method is provided of transferring satellite digital audio channel information to a radio display module. The method includes: broadcasting radio display type information on a in-vehicle communication network; storing a value in the radio display module to indicate a current version of at least one channel information table in the radio display module; sending a value to the radio display module to indicate the current version of the channel information table stored in a satellite receiver module; requesting the satellite receiver module to send the current channel information table; transforming the channel information table into a message protocol structure within a data stream whereby the data stream is transmitted to the radio display module; and storing the data stream into an address in the radio display module.

9 Claims, 7 Drawing Sheets

29

38

Basic GCI Channel Number Table

| Channel Number |
|---|
| 1 |
| 2 |
| 8 |
| 10 |
| 14 |
| 19 |
| ... |
| 196 |
| ... |

30

40

GCI Channel Number/PTY Code/Station Name Table

| Channel Number | PTY Code | Station Name |
|---|---|---|
| 1 | 1 | GREAT DIRT |
| 2 | 1 | HARP TRENDS |
| 8 | 1 | FREEWAY |
| 10 | 2 | ANIMAN |
| 14 | 2 | CENTERED |
| 19 | 3 | ... |
| ... | ... | COMPUCHAT |
| 196 | 20 | ... |
| ... | ... | |

30 32 34

42

GCI PTY Code/ Category Name Table

| PTY Code | Category Name |
|---|---|
| 1 | Hits |
| 2 | Rock |
| 3 | COUNTRY |
| 4 | RNB |
| 5 | JAZZ |
| 6 | STD? |
| ... | |
| 20 | ENTANMNT |
| ... | |

32 36

FIG. - 3

SATELLITE TO VEHICLE DATA COMMUNICATION METHOD

FIELD OF THE INVENTION

The present invention relates generally to a method for transferring radio channel information on an in-vehicle communication network from a satellite digital audio radio (SDAR) module to a radio display module on a message by message basis.

BACKGROUND OF THE INVENTION

As digital satellite audio radio networks become more popular and the demand rises to display more information on the radio display, a faster more efficient way of transmitting channel information feedback to the network user on request becomes increasingly important. Therefore, it would be desirable to provide a method that allows the radio display module to quickly transfer and display radio channel information upon the network user's request when selecting a radio station or channel. Additionally, it would be desirable to allow this communication protocol and algorithm the flexibility to use different radio head unit display types such as: 7-segment display, re-configurable VFD display, and fully reconfigurable VFD display. Moreover, it would be desirable for the proposed communication protocol and algorithm to contribute to overall system flexibility which allows the ability to seamlessly integrate a satellite digital audio radio (SDAR) module within the radio display module in the future for potential saving in cost, communication bandwidth, and system memory allocation.

SUMMARY OF THE INVENTION

A method of transferring satellite digital audio channel information to a radio display module begins by sending an indicator to the radio display module corresponding to a version of a channel information table stored in a satellite receiver module. The radio display module requests the satellite receiver module to send the channel information table to the radio display module, if the version of the channel information table stored in the satellite receiver module is different from a version stored in the radio display module. The channel information table at the satellite receiver module is then transformed into a message protocol structure within a data stream, the message protocol structure including a header portion and a message portion, the header portion including indicators for a size of the message portion and for a type of channel information to be sent, whereupon the data stream is transmitted to the radio display module.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 shows three tables constructed by the radio display module and SDAR module which can be implemented in five different ways;

DETAILED DESCRIPTION OF THE PREFERRED EMBODIMENTS

The following description of the preferred embodiments is merely exemplary in nature and is in no way intended to limit the invention, its application, or uses.

Figure 1:
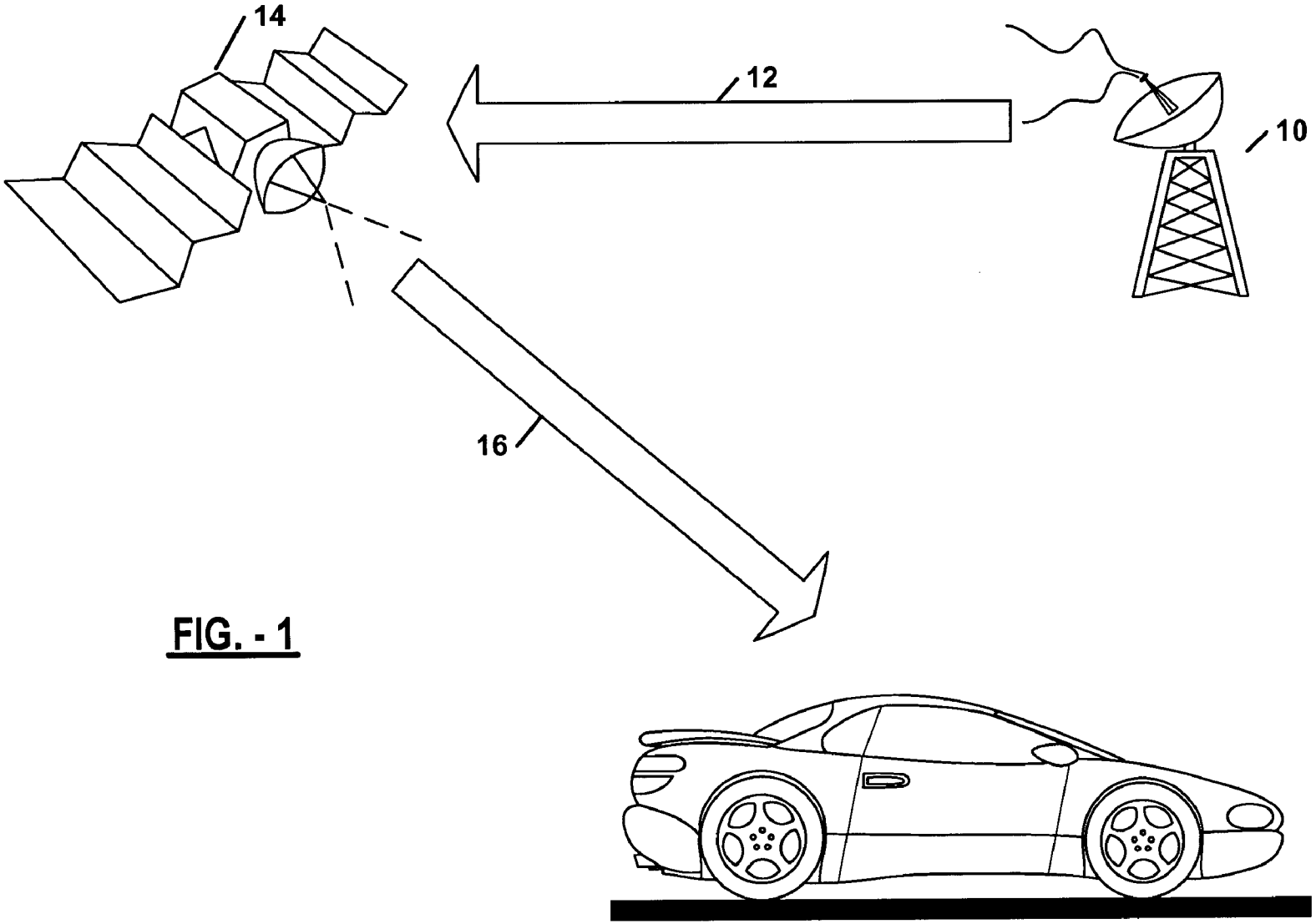
FIG. 1 schematically illustrates a satellite digital audio radio system.

FIG. 1 illustrates a scheme of transferring signals in a satellite based system. The radio broadcasting station 10 broadcasts signals 12 to a satellite 14 which transmits audio and channel information 16 to a vehicle 18.

Figure 2:
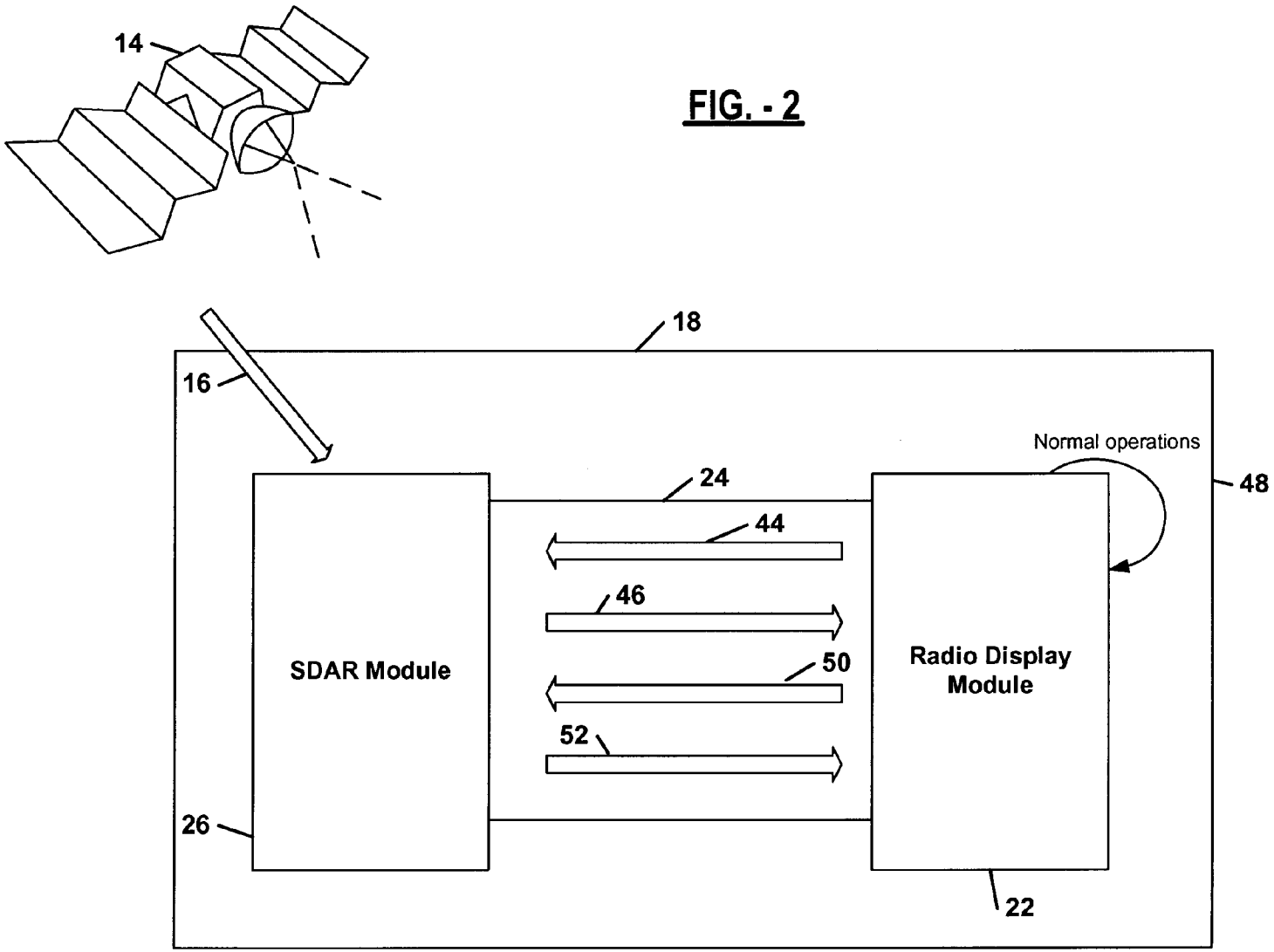
FIG. 2 schematically illustrates a basic transfer method between a SDAR module and a radio display module.

FIG. 2 illustrates a satellite digital audio communication system which transfers channel information to be displayed by a radio display module 22. The radio display module 22 includes, but is not limited to, a tuner and a display (not shown). The radio display module 22 is connected to an in-vehicle communication network 24 by which it receives and transmits data. A satellite digital audio radio (SDAR) module 26 is also connected to the in-vehicle communication network 24 by which it sends and receives data. The SDAR module 26 includes, but is not limited to, an antenna, a receiver, and other electronic devices (not shown).

Every three to six months a satellite 14 will automatically update the channel information stored in the SDAR module 26. As will be described below, the present invention provides a method to transfer the updated channel information from the SDAR module 26 to the radio display module 22. Advantageously, according to the present invention more channel information can be transferred at a higher rate than with conventional methods.

In FIG. 3 the channel information stored in the SDAR module 26 may include, but is not limited to channel numbers 30, program type (PTY) codes 32, station names 34, category names 36 and combinations thereof. FIG. 3 illustrates this information compiled into three global channel information (GCI) Tables 29 that represent five GCI Tables which include: a Basic GCI Channel Number Table 38, a short or long form GCI Channel Number/PTY code/Station name Table 40, and a short or long form GCI PTY code/Category name Table 42. The short form and long form tables are very similar with the exception to the number of characters allotted for the station name 34 and category name 36 for each type of table. The short form and long form tables are allotted eight and twenty-two characters, respectively.

The Basic GCI Channel Number Table 38 contains an array of all SDAR channels that will be used for a 7-segment radio display type. The channel number 30 is an array of all SDAR channel numbers and each one is assigned to a specific SDAR radio station which allows a user to identify radio stations by channel number 30 when deciding upon which radio station to listen.

The short form of the GCI Channel number/PTY code/Station name Table 40 contains an array of channel numbers 30, short form PTY codes 32 and short form station names 34 that will be used for a re-configurable VFD radio display type. The PTY code 32 is a program code which is included in a data stream to allow the user to scan for radio stations having a specific program format, specifying the station's "program type" (e.g., Rock, Pop, etc.). Therefore, more than one station may have the same Category name 36 (or "program type") and the corresponding PTY code 32. The station name 34 is a SDAR name assigned to identify each SDAR radio station.

The short form of the GCI PTY code/Category name Table 42 contains an array of short form PTY codes 32 and the corresponding short form category names 36 that are used for the reconfigurable VFD radio display type. The category name 36 is a particular classification, genre of music, or a classification of programs aired by the radio station. The PTY codes 32 are the same as above.

The long form of the GCI Channel number/PTY code/Station name Table 40 contains an array of channel numbers 30, long form PTY codes 32 and long form station names 34 which will be used for a fully re-configurable VFD radio display type. The long form of the GCI PTY code/Category name Table 42 contains the long form PTY Code 32 and the corresponding long form category name 36 which will also be used for the fully re-configurable radio display type. The long form channel numbers 30 and long form station names 34 are the same as described above.

Referring to FIGS. 2 and 3, upon specific power-up or another ready condition for both the radio display module 22 and SDAR module 26, the radio display module 22 broadcasts its radio display type 44 on the in-vehicle communication network 24 such that the SDAR module 26 will read the radio display type. The SDAR module 26 broadcasts a checksum value 46 when a new GCI Table 29 is present in the SDAR module 26. The radio display module 22 includes a stored checksum value indicating its current version of GCI Table.

After receiving the checksum value from the SDAR module 26, the radio display module 22 decides if a new GCI Table 29 is available from the SDAR module 26. If the checksum value is the same as the checksum value stored inside of the radio display module 22, the radio display module 22 continues normal operations 48 using the currently stored GCI table(s) 29. If the checksum from the SDAR module 26 is different from the checksum value stored in the radio display module 22, the radio display module 22 requests the SDAR module 26 to send the updated GCI Table(s) 29 for the radio display type 50.

Next, the SDAR module 26 sends an information packet 52 including the appropriate GCI Tables 29 for the specific radio display type. For example, if the radio display type is a reconfigurable VFD Radio display type, the SDAR module 26 sends the channel information data for the short form GCI Channel number/PTY code/Station name Table 40 and/or the short form GCI PTY code/Category name Table 42. Additionally, after the radio display module 22 receives the checksum value, if it determines for any reason that the GCI Tables 29 are needed (e.g. for repairs, etc.), the radio display module 22 requests the GCI Tables 29 from the SDAR module 26.

Although other networks may be available, the present invention preferably utilizes available in-vehicle communication network 24 protocols, Controller Area Network (CAN) or J1850 protocol. The embodiment described below utilizes the CAN protocol. The message protocol structure in the CAN protocol contains eight data bytes. These data bytes are defined to implement the new protocol used to transfer the GCI Tables 29.

Figure 4:
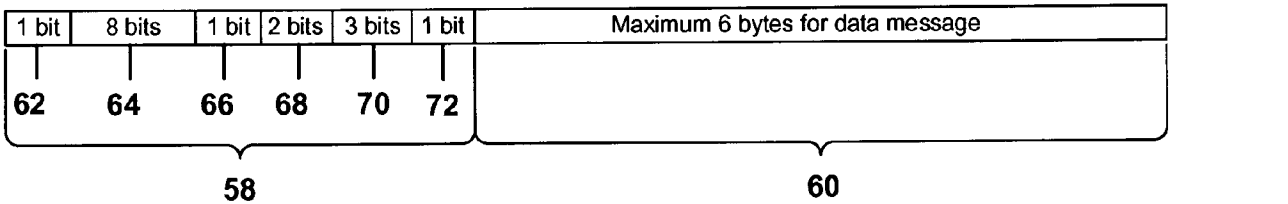
FIG. 4 illustrates a message protocol structure for a Basic Global Channel Information (GCI) Channel Number Table.

FIG. 4 illustrates the message protocol structure 56 for the Basic GCI Channel Number Table 38 of FIG. 3. The message protocol structure 56 for the Basic GCI Channel Number Table 38 contains a header 58 and a data message 60, as will become part of all of the other message protocol structures described herein.

The header 58 includes the first two bytes of the structure. This guarantees the integrity of the data sent from the SDAR module 26 to the radio display module 22. The data message 60 comprises the remaining six available bytes.

More particularly, the message protocol structure 56 has a top to bottom level structure for the two byte header 58. Upon a GCI table transfer, the SDAR module 26 transmits at least one GCI Table 29 to the radio display module 22. Each GCI Table 29 contains at least one record. Each record consists of at least one group. The group contains a data message 60 equal to or less than six-bytes. In the event that there is more than one group or more than one six-byte data message 60, multiple groups are sent to transfer the complete record (see FIGS. 5 and 6).

The first bit 62 of the header 58 is used as a Table Record Highest Group Mark 62. The Table Record Highest Group Mark 62 is set to 1 for the first record in any GCI Table 29 and changed to 0 for the remaining records in that GCI Table 29. As such, the radio display module 22 and SDAR module 26 use this bit as a pointer to indicate the first record in the GCI Table 29.

A Table Record Group Number 64, which is assigned the next eight bits 64 in the header 58, indicates the number of records in the GCI Table 29 to be transferred from the SDAR module 26 to the radio display module 22. When the Table Record Highest Group Mark 62 is set to 1, indicating that it is the first group, the Table Record Group Number 64 is set to the total number of records in the table. The Table Record Group Number 64 is then decremented by 1 for the next consecutive table records until it reaches 1, which indicates that it is the last record in the GCI Table 29.

The next bit 66 of the header 58 is a One Record Highest Group Mark 66. The One Record Highest Group Mark 66 is set to 1 for the highest group number or highest number of six-byte data messages 60 in the record, which indicates whether the group is the first six-byte data message 60 to be sent. After the first group of the record is sent, the One Record Highest Group Mark 66 is set to 0 for the remaining groups transferred within that record. If there are multiple groups for a record, this indicates that the data message 60 was larger than the six-bytes allocated. The radio display module 22 uses this bit to reconstruct one complete table record.

The next two bits 68 are a One Record Group Number 68. The One Record Group Number 68 is set to the number of groups in the record. When the One Record Highest Group Mark 66 is set to 1 then the One Record Group Number 68 indicates the total number of groups within that record. The One Record Group Number 68 decrements by 1 for the next consecutive messages of groups until it reaches 1. This indicates that this group is the last group in that record.

The next 3 bits 70 are a Table Group Type 70. The Table Group Type 70 indicates the type of GCI Table 29 that is being transferred. The radio display module 22 uses these bits to determine the number of individual GCI Tables 29 that the SDAR module 26 is sending. The Table Group Type 70 bit structures are indicated as follows: 000=Basic GCI Channel Number Table 38, 001=short form of the GCI Channel number/PTY code/Station name Table 40, 010=short form of the GCI PTY code/Category name Table 42, 011=long form of the GCI Channel number/PTY code/Station name Table 40, and 100=long form of the GCI PTY code/Category name Table 42.

The radio display module 22 verifies that the last GCI Table 29 for the 7-segment radio display will be with the Table Group Type 70 set to 0 (000). The radio display module 22 verifies that the last GCI Table 29 for the re-configurable VFD radio display is the Table Group Type 70 set to 2 (010). The radio display module 22 verifies that the last table for the fully re-configurable VFD radio display is the Table Group Type 70 set to 4 (100).

The last bit 72 in the header 58 is reserved and used only for long form GCI Tables 29 with fully reconfigurable VFD radio display type. This last bit 72 combines with the two-bits assigned for the One Record Group Number 68 to determine the number of groups for the One Record Group Number 68 for the fully reconfigurable VFD radio display type. The preferred maximum number of six-byte data messages 60 for the fully reconfigurable VFD display radio type is four. Thus, the SDAR module 26 sends all the contents of the GCI Tables 29 in a data stream on the in-vehicle communication network 24 such that the radio display module 22 can reconstruct the appropriate GCI Tables 29.

The data message 60 is used to transfer the data of the GCI table 29. That is, the data message 60 can be used to contain the channel numbers 30, PTY codes 32, station names 34, and/or category name 36. In the embodiment illustrated, the data message 60 contains channel numbers 30.

Figure 5:
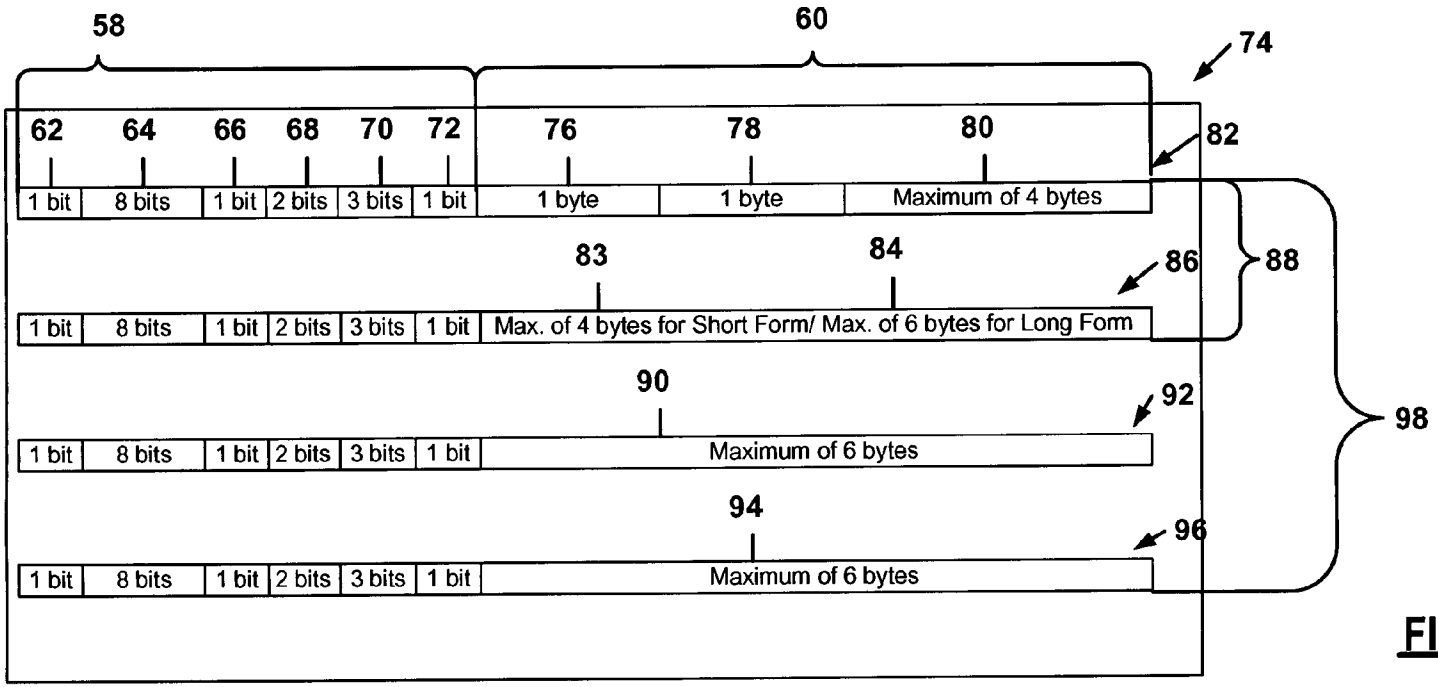
FIG. 5 illustrates a message protocol structure for a GCI Channel number/Program Type (PTY) code/Station Name Table with short form and long form messages.

FIG. 5 illustrates the message protocol structure 74 for GCI Channel number/PTY Code/Station name Table 40 which contains the same general structure as above including two bytes for the header 58 and six bytes for the data message 60. The header 58 is the same format as described above. The data message 60, however, contains different information based on the type of GCI Table 29 being requested and transmitted.

For the message protocol structure 74 for GCI Channel number/PTY Code/Station name Table 40, there are a total of two messages for each table record (structure 88), a first message 82 and a second message 86 sent regarding the short form of GCI Channel number/PTY code/Station name Table 40, and a total of four messages for each table record (structure 98): the first message 82, the second message 86, a third message 92, and a fourth message 96 regarding the long form of GCI Channel number/PTY code/Station name Table 40.

Additionally, the first message 82 includes the data message 60 which contains one byte 76 for the channel number 30, one byte 78 for the PTY codes 32, and a up to four bytes 80 for the station names 34. The second message 86 includes the data message 60 which contains up to four bytes 83 for the station names 34 for the short form of the GCI Channel Number/PTY code/Station name Table 40 (structure 88), and up to six bytes 84 for the station names 34 for the long form of the GCI Channel number/PTY code/Station name Table 40 (structure 98). The third message 92 and fourth message 96 include the data message 60 which contain up to six bytes 90 and 94 for the station names 34 for the long form of the GCI Channel number/PTY code/Station name Table 40 (structure 98). The third message 92 and fourth 96 message are used for the long form of the GCI Tables 29 or the fully reconfigurable radio display types.

Figure 6:
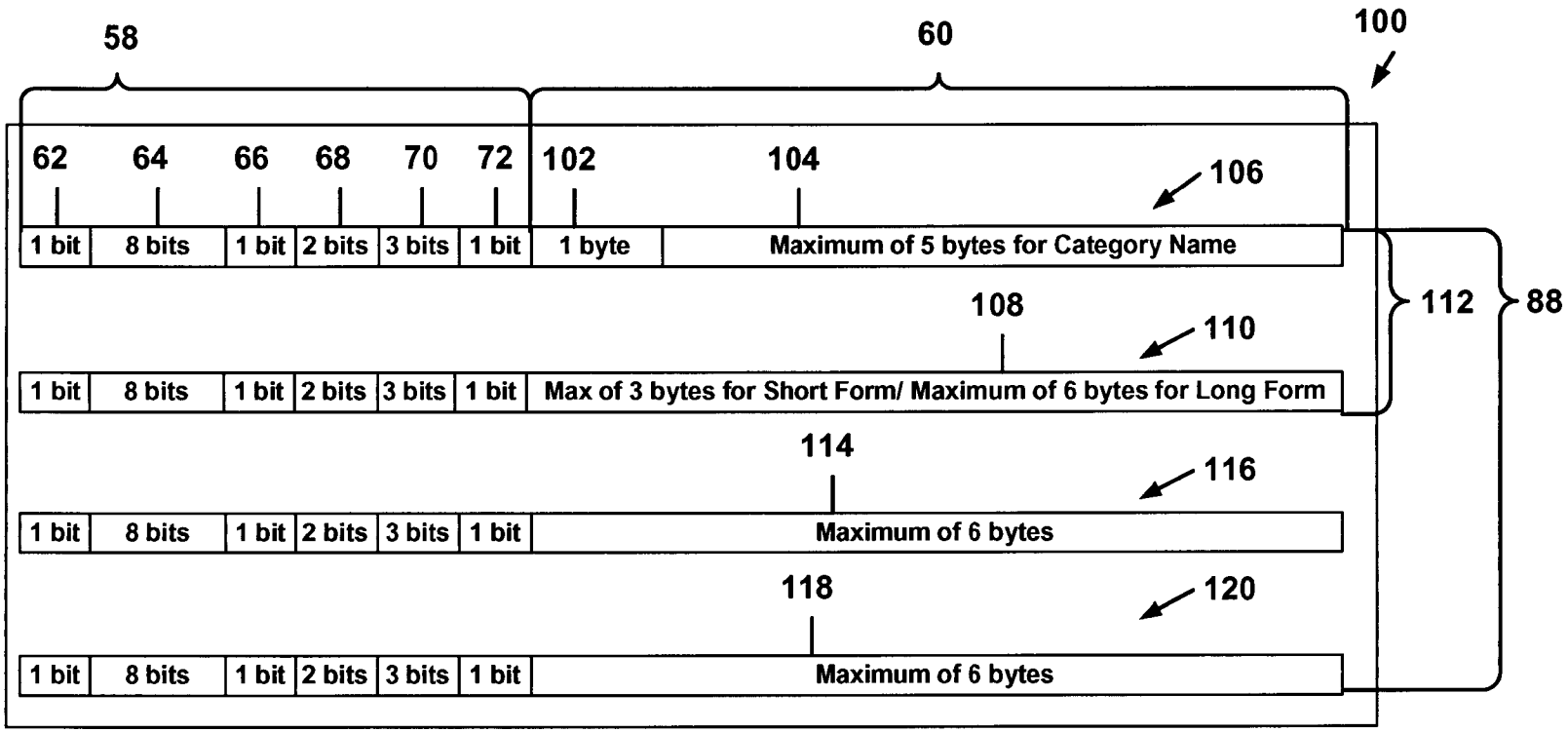
FIG. 6 illustrates a message protocol structure for a GCI PTY code/Category Name Table with short form and long form messages.

FIG. 6 illustrates a message protocol structure 100 for GCI PTY code/Category name Table 42. The short form for one table record contains two messages (structure 112), a first message 106 and a second message 110. The long form for one table record contains four messages (structure 122): the first message 106, the second message 110, a third message 116, and a fourth message 120. The first message 106 and second message 110 are the same for both the short form and the long form versions of the GCI PTY code/Category name Table 42. The header 58 is the same as described above.

The first message 106 includes data message 60 which contains one byte 102 for the PTY codes 32 and up to five bytes 104 for the category name 36. The second message 110 includes the data message 60 which contains up to three bytes 108 for the short form and up to six bytes 109 for the long form of the GCI PTY code/Category name Table 42. The third message 116 and fourth message 120 include the data messages 60 which contain up to six bytes 114 and 118 for the category name 36 for the long form of the GCI PTY code/Category name Table 42.

Figure 7A:
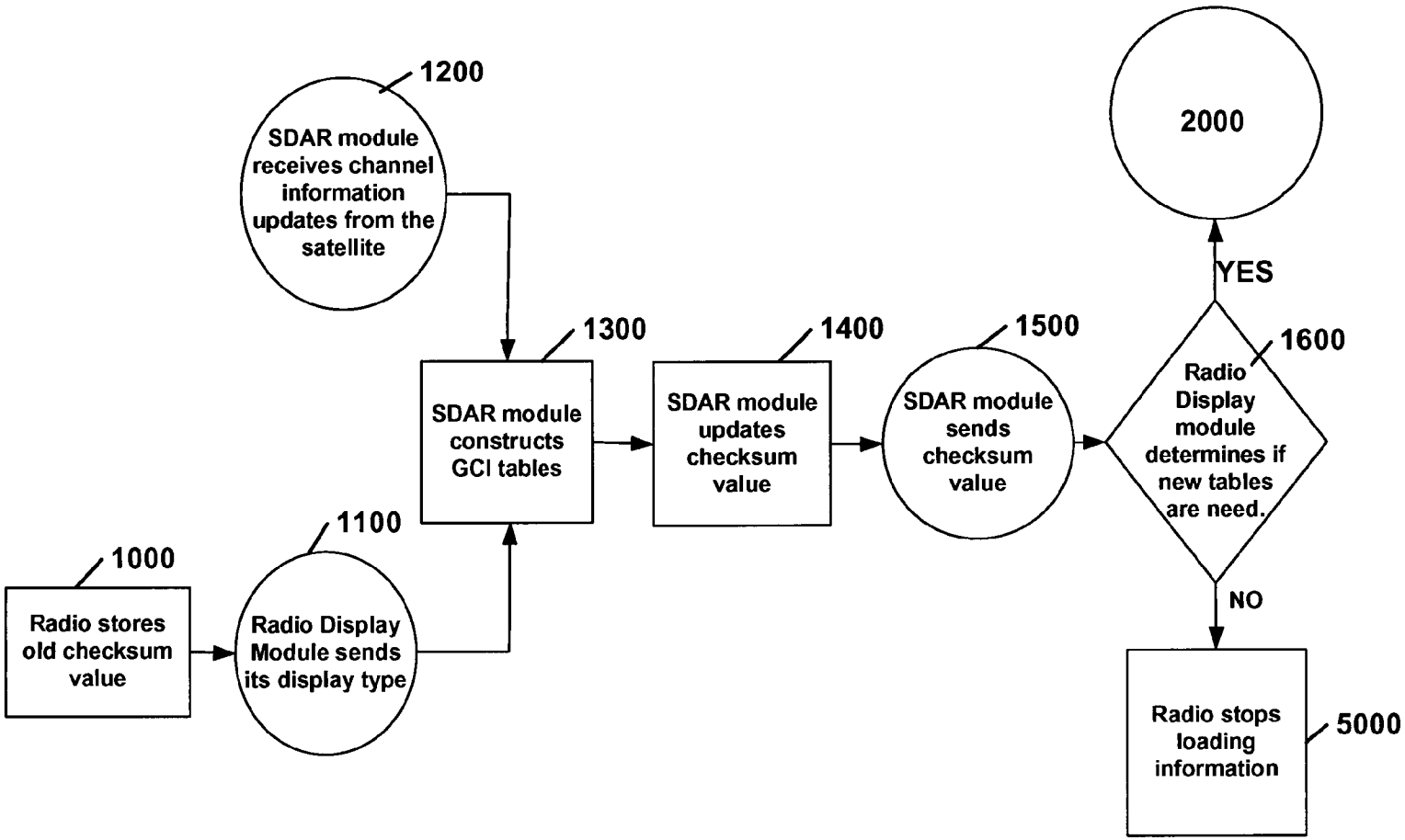
FIGS. 7A and 7B illustrate an algorithm used to implement the message protocol structures for the GCI tables.
Figure 7B:
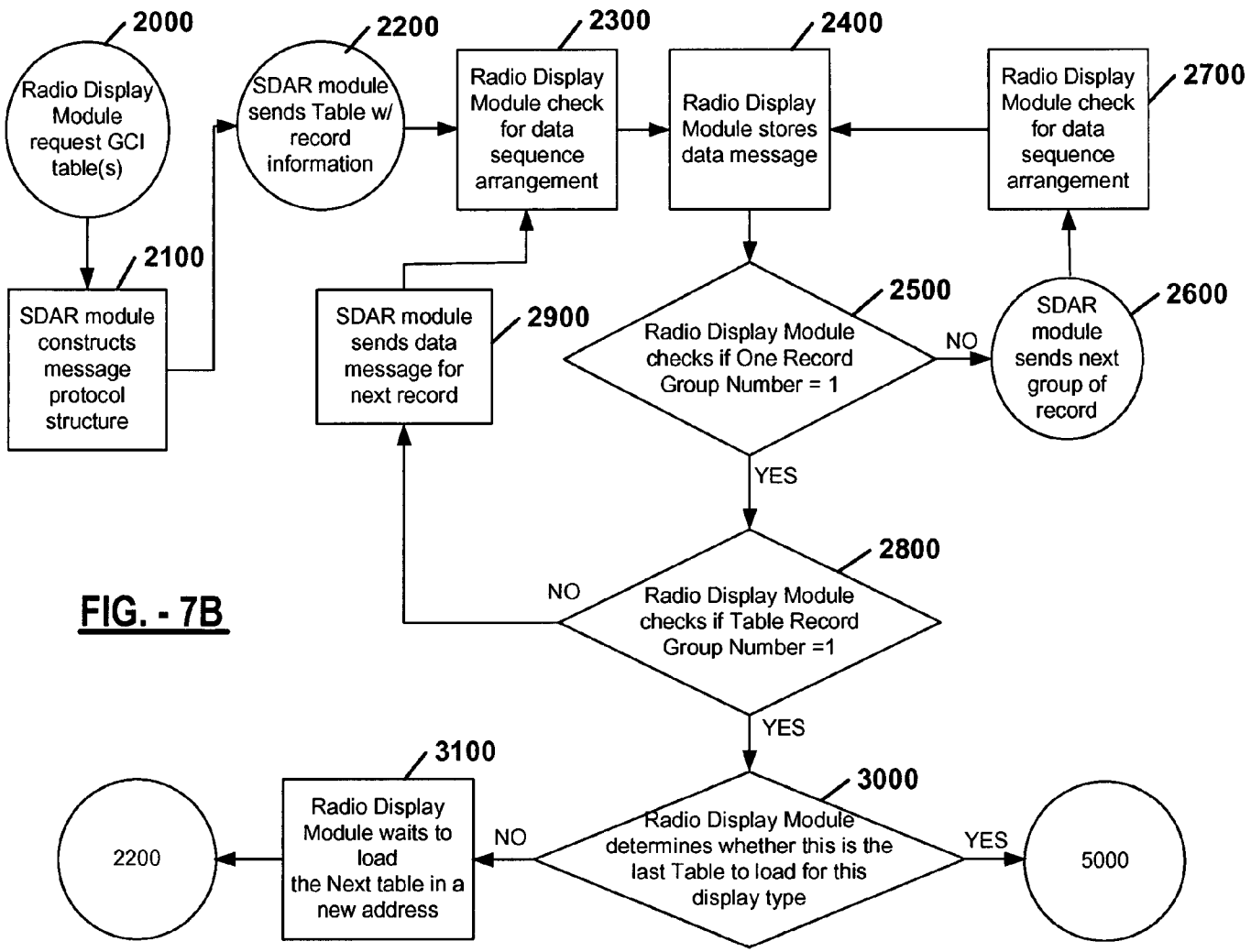

FIGS. 7A and 7B illustrate a block diagram of an algorithm facilitating the message protocol structures described above which transfer the GCI Tables 29 from the SDAR module 26 to the radio display module 22. In order to provide a better understanding of the algorithm, an example will now be provided. In this example, the radio display type is assumed to be a reconfigurable radio display type and the SDAR module 26 is assumed to have one hundred fifty records in a GCI table 29 with up to two groups per record to be sent.

Turning now to FIG. 7A, the method begins in block 1000. Upon power up or any other desired start-up condition, the radio display module 22 stores the previously loaded or default GCI Tables 29 in block 1000. Additionally in block 1000, the radio display module 22 stores the current checksum value which corresponds to the current version of the GCI Tables 29 stored in the radio display module 22. Once this storage operation is completed, it may not need to be repeated at additional start-up events.

Next, the method proceeds to block 1100. In block 1100, the radio display module 22 broadcasts the radio display type 44 (e.g., reconfigurable radio display type) to the SDAR module 26. In block 1200, the SDAR module 26 periodically receives updated channel information from the satellite 14. In block 1300, the SDAR module 26 constructs and stores the above described five GCI Tables 29. After storing the five GCI Tables 29 in block 1300, the method advances to block 1400.

In block 1400, the SDAR module 26 updates the checksum value in the SDAR module 26. After the checksum value is updated by the method in block 1400, the method continues to block 1500. In block 1500, the SDAR module 26 sends the checksum value to the radio display module 22. Upon receipt of the SDAR module's 26 checksum value, the method advances to block 1600.

In block 1600, the radio display module 22 compares the radio display module's 22 checksum value to the SDAR module's 26 checksum value. If the radio display module's 22 checksum value is different from the SDAR module's 26 checksum value, the method proceeds to block 2000. In block 2000, the radio display module 22 requests the SDAR module 26 to send the channel information in its GCI Tables 29 for the reconfigurable radio display type. On the other hand, if the radio display module's 22 checksum value is equal to the SDAR module's 26 checksum value in block 1600, the method proceeds to block 5000. In block 5000, the radio display module 22 stops loading information and continues with normal operations 48.

Turning now to FIG. 7B, once the SDAR receives the request in block 2000, the method proceeds to block 2100. In block 2100, the SDAR module 26 transforms the stored GCI Tables 29 into the short form message protocol structure 74 for the GCI Channel number/PTY code/Station name Table 40 and short form message protocol structure 100 for GCI PTY code/Category name Table 42. Additionally, in block 2100, the SDAR module 26 sets the bits in the message protocol structure 100 and transfers the data in a data stream to the radio display module 22. For example, the SDAR module 26 sets the Table Record Highest Group Mark 62 to 1, Table Record Group Number 64 to 150, One Record Highest Group Mark 66 to 1, One Record Group Number 68 to 2 and Table Group Type 70 to 001.

Next, the method advances from block 2100 to block 2200. In block 2200, the SDAR module 26 sends the short form message protocol structure 74 for the GCI Channel number/PTY code/Station name Table 40 for the first message 82 (e.g., 1, 150, 1, 2, 001, a byte 196 for channel number 30, a byte for the PTY code 32=20, 4 bytes for channel name="TEC"). In block 2300, the radio display module 22 verifies the data to confirm that it is provided in the proper sequence.

The method then advances from block 2300 to block 2400. In block 2400, the radio display module 22 reconstructs the GCI Channel number/PTY code/Station name Table 40 from data message 60 in the message protocol structure. Moreover, the GCI Channel number/PTY code/Station name Table 40 is reconstructed when the radio display module 22 stores a byte 76 for channel number 30, a byte 78 for the PTY code 32 and four bytes 80 for channel name "TEC" Next the method proceeds to block 2500 where the radio display module 22 checks if the One Record Group Number 68 equals 1.

If the One Record Group Number 68 does not equal 1, then the method advances to block 2600. In block 2600, the radio display module 22 waits to load the next data message 60 in the same address. On the other hand, if the One Record Group Number 68 does equal 1, then the method moves to block 2800. In block 2800, the radio display module 22 checks if Table Record Group Number 64 equals 1.

In this example, the One Record Group Number 68 equals 2. Thus, the method moves to block 2600. In block 2600, the SDAR module 26 sets the Table Record Highest Group Mark 62 to 1, Table Record Group Number 64 to 150, One Record Highest Group Mark 66 to 0, One Record Group Number 68 to 1, and Table Group Type 70 to 001. Additionally in block 2600, the SDAR module 26 sends the message protocol structure 74 the GCI Channel number/PTY code/Station name Table 40 for the second message 86 or group of the record (1, 150, 0, 1, 001, four bytes 83 for channel name 30="TALK"). After the radio display module has received the data from block 2600, the method proceeds to block 2700.

In block 2700, the radio display module 22 checks to make sure that the data has arrived in the proper sequence. If the data has arrived in the proper sequence, the method proceeds to block 2400. In block 2400, the radio display module 22 store the data message 60 in the GCI Table 29. On the other hand, If the data has not arrived in the proper sequence, the method causes the radio display module to request the missing data. After storing the data in block 2400, the method returns to block 2500.

In block 2500, the radio display module 22 checks if the One Record Group Number 68 is set to 1. If the One Record Group Number 68 is not set to 1, the method causes the radio display module 22 to wait to load the next message in the same address. On the other hand, if the One Record Group Number 68 is set to 1, the method moves to block 2800.

In block 2800, the radio display module 22 checks if the Table Record Group Number 64 equals 1. In this example, the One Record Group Number 68 is set to 1. Thus, the radio display module 22 waits to load the next record.

Assuming that the SDAR module 26 has just completed table record #2; and, the SDAR module 26 is currently sending the last record in that table, the SDAR module 26 sets the Table Record Highest Group Mark 62 to 0, Table Record Group Number 64 to 1, One Record Highest Group Mark 66 to 1, One Record Group Number 68 to value to 1, and Table Group Type 70 set to 001. After the SDAR module sets the bits as above, the method proceeds to block 2900. In block 2900, the SDAR module 26 sends the message protocol structure 74 for GCI Channel number/PTY code/Station name table for the first message 82 or group (0, 1, 1, 1, 001, a byte 76 for the channel number 30=1, a byte 78 for the PTY code 32=1, four bytes for channel name 80="US 1").

Next, the method advances from block 2900 to block 2300. In block 2300, the radio display module 22 verifies the data was sent in the proper sequence. After verifying that the data is properly sequenced, the method advances to block 2400. In block 2400, the radio display module 22 stores the data message 60 in the GCI Channel number/PTY code/Station name Table 40. After storing the data, the method advances to block 2500.

In block 2500, the radio display module 22 checks if the One Record Group Number 68 is set to 1 as described above. Assuming the One Record Group Number 68 is set to 1, the method moves to block 2800. In block 2800, the radio display module 22 checks if the Table Record Group Number 64 is set to 1. In this example, the Table Record Group Number 64 is set to 1. Thus, the radio display module 22 determines that this is the last record entry for this table. Therefore, the method proceeds from block 2800 to block 3000.

In block 3000, the radio display module 22 determines whether there is another table to load (010 for a reconfigurable radio display type). If there is another table to load, the method proceeds to block 3100. In block 3100, radio display module 22 waits to load the next GCI Table 29. On the other hand, if there is no other table to load, the method proceeds to block 5000. In block 5000, radio display module 22 stops loading GCI Tables 29.

In this example, the radio display module 22 determines that it should receive another GCI Table 29 because it is a reconfigurable radio display type and the Table Type Number is set to 001. Therefore, the method advances to block 3100. In block 3100, the radio display module 22 waits to load the next GCI Table 29. From block 3100, the method advances to block 2200. Thereafter, the method continues along the foregoing until no additional tables are left to load.

For example, for a second GCI Table 29, assume that the SDAR module 26 sets the Table Record Highest Group Mark 62 to 1, Table Record Group Number 64 to 20, One Record Highest Group Mark 66 to 1, One Record Group Number 68 to value to 2, and Table Group Type 70 set to 010. In block 2200, the SDAR module 26 sends the message protocol structure 100 for GCI PTY Code/Category name Table 42, a first message 106 or group, (1, 20, 1, 2, 010, a byte 102 for the PTY code 32=20, five bytes 104 for category name 36="ENTAN").

In block 2300, the radio display module 22 verifies that the data was sent in the proper sequence. After verifying the data sequence, the method advances to block 2400. In block 2400, the radio display module 22 stores the data message 60 in the GCI Tables 29. The method then proceeds to block 2500.

In block 2500, the radio display module 22 checks if the One Record Group Number 68 is set to 1. If no, then the method proceeds to block 2600. In block 2600, the radio display module 22 waits to load the next data message 60 in the same address. If yes, then the method proceeds to block 2800. In block 2800, the radio display module 22 checks if the Table Record Group Number 64=1.

Here, the One Record Group Number 68 is set to 2, so the method moves from block 2500 to block 2600. In block 2600, the radio display module 22 waits to load the next group or the first message 106; the SDAR module 26 sets the Table Record Highest Group Mark 62 to 1, Table Record Group Number 64 to 20, One Record Highest Group Mark 66 to 0, One Record Group Number 68 to 1, and Table Group Type 70 to 010. Additionally in block 2600, the SDAR module 26 sends the message protocol structure 100 for GCI PTY code/Category name Table 42 for the second message 110 or group of that table record (1, 20, 0, 1, 010, three bytes 108 for Category name 36="MNT"). Next, the method proceeds from block 2600 to block 2700.

In block 2700, the radio display module 22 verifies the data sequence arrangement. After verifying the data sequence in block 2700, the method proceeds to block 2400. In block 2400, the radio display module 22 stores the data message 60 in the GCI Channel number/PTY code/Station name Table 40. Next, the method advances from block 2400 to block 2500. In block 2500, the radio display module 22 verifies if the One Record Group Number 68 is set to 1. If so, the method advances to block 2800.

In block 2800, the radio display module 22 checks if the Table Record Group Number 64 is set to 1. Since in this example the Table Record Group Number 64 is set to 20, the method proceeds to block 2900. In block 2900, the radio display module 22 waits for the SDAR module 26 to send the next record and the method proceeds. This process continues until the SDAR module 26 has sent the last record in the GCI Table 29.

Once the last record has been sent by the SDAR module 26 and stored in the radio display module 22, the method moves from block 2500 to block 2800. In block 2800, the radio display module 22 determines whether this is the last record entry for the second GCI Table 29 (0,1,0,1,010). If so, the method proceeds to block 3000. In block 3000, the radio display module 22 checks if there is another GCI Table 29 to load (010 for a reconfigurable radio display type). If not, the method proceeds to block 3100. In block 3100, the radio display module 22 waits to load the next table. If so, (as is this case), the method proceeds to block 5000. In block 5000, the radio module 22 stops loading the GCI Tables 29 and continues with normal operations 48.

Additionally, it should be appreciated that if the radio display module 22 receives a message protocol structure out of sequence then the radio display module 22 requests that the SDAR module 26 resend the data record. The radio display module 22 preferably sends this message three times before timeout. Upon timeout, the radio display module 22 sets up pre-selected default GCI Tables 29.

The new method employed by this invention allows for a faster more efficient data transfer of channel information to the radio display module 22. Additionally, this method allows the user to quickly switch between channels. The method uses only one protocol message that is sent multiple times to save in-vehicle communication network bandwidth and number of message identifications. Instead of loading channel information in the radio display module 22 on a bit by bit basis on user command with numerous message identifications, the invention provides a method which loads and stores all SDAR channel information in the radio display module 22 prior to the user's command for channel information for instant display.

The GCI Table 29 transfer time depends on the size of the GCI Table 29 and the speed and latency of the in-vehicle communication network 24. The GCI Table 29 size depends on a number of factors such as: the number of channels 30, number of bytes reserved for each station name 34, the number of PTY codes 32, and the number of bytes reserved for each category name 36. The method as shown is capable of transferring 6.6 Kbytes within 90 seconds with only 3% network load increase during the transfer time, assuming 20 category types, normal network load and latency factors and 83.3 kbps speed for CAN communication network. For a typical 7-segment radio display type, the algorithm showed that the GCI Table 29 are successfully transferred within 2 seconds given that the GCI Table 29 has only one hundred fifty channel numbers 30. For the reconfigurable VFD radio display type, the algorithm showed that the GCI short form tables were successfully transferred within 30 seconds given that the GCI short form tables contains one hundred fifty channel numbers 30 and station names 34, eight characters for every station name 34 and twenty category names 36. For the fully reconfigurable VFD radio display type, the algorithm showed that the GCI long form tables were successfully transferred within 70 seconds given that the GCI Table 29 contains one hundred fifty channel numbers 30 and station names 34, twenty-two characters for every station name 34 and twenty-three characters for twenty category names 36.

Additionally, this invention contemplates that the SDAR module 26 may become integrated into the radio display module 22 to save cost, bandwidth and system memory allocation.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of transferring satellite digital audio channel information to a radio display module comprising:

sending an indicator to the radio display module corresponding to a version of a channel information table stored in a satellite receiver module;

requesting the satellite receiver module to send the channel information table to the radio display module if the version of the channel information table stored in the satellite receiver module is different from a version stored in the display module;

transforming at the satellite receiver module the channel information table into a message protocol structure within a data steam, the message protocol structure including a header portion and a message portion, the header portion including indicators for a size of the message portion and for a type of channel information table to be sent; and transmitting the data stream to the radio display module.

2. The method of claim 1 wherein the indicator corresponding to a version of a channel information table stored in a satellite receiver module comprises a checksum.

3. The method of claim 1 wherein the header portion further comprises:

an indicator of whether a current record of a table being sent in the protocol structure is a first record of the protocol structure;

an indicator of a total number of records in the table being sent;

an indicator whether a data message in the protocol structure is a first data message of the protocol structure; and an indicator of a total number of groups in the current record being sent.

4. The method of claim 1 wherein the channel information table includes at least one of the of the group consisting of channel numbers, program type codes, station names, and category names.

5. The method of claim 1 wherein the type of channel information table further comprises at least one of the group consisting of:

a first table including channel numbers;

a second table including short form channel numbers, program type codes, and station names;

a third table including long form channel numbers, program type codes, and station names;

a fourth table including short form program type codes and category names; and a fifth table including long form program type codes and category names.

6. The method of claim 1 further comprising re-constructing the channel information table in the radio display module.

7. The method of claim 1 further comprising storing at the radio display module the indicator corresponding to the version of the channel information table stored in the satellite receiver module sent to the radio display module.

8. A method of transferring satellite digital audio channel information to a radio display module comprising:

sending an indicator to the radio display module corresponding to a version of a channel information table stored in a satellite receiver module;

requesting the satellite receiver module to send the channel information table to the radio display module if the version of the channel information table stored in the satellite receiver module is different from a version stored in the radio display module;

transforming at the satellite receiver module the channel information table into a message protocol structure within a data steam, the message protocol stucture including a header portion and a message portion and a message portion, the header portion including indicators for a size of the message portion, for a type of channel information table to be sent, and for whether a current record of a table being sent in the protocol stucture is a first record of the protocol structure; and transmitting the data stream to the radio display module.

9. A method of transferring satellite digital audio channel information to a radio display module comprising:

sending an indicator to the radio display module corresponding to a version of a channel information table stored in a satellite receiver module;

requesting the satellite receiver module to send the channel information table to the radio display module if the version of the channel information table stored in the satellite receiver module is different from a version stored in the radio display module;

transforming at the satellite receiver module the channel information table into a message protocol structure within a data stream, the message protocol structure including a header portion and a message portion, the header portion including indicators for a size of the message portion, for a type of channel information table to be sent, and for a total number of records in the table being sent; and transmitting the data steam to the radio display module.

* * * * *